US006193219B1

(12) United States Patent
Belley et al.

(10) Patent No.: US 6,193,219 B1
(45) Date of Patent: Feb. 27, 2001

(54) HEAVY VEHICLE LIFTING DEVICE AND METHOD

(75) Inventors: Christian Belley, Sept-Iles; Serge Marinier; Jean Briand, both of Fermont, all of (CA)

(73) Assignee: I.C.I. Côte-Nord Inc., Sept-Iles (CA)

( * ) Notice: Subject to any disclaimer, the term of this patent is extended or adjusted under 35 U.S.C. 154(b) by 0 days.

(21) Appl. No.: 09/235,305

(22) Filed: Jan. 22, 1999

Related U.S. Application Data

(63) Continuation of application No. PCT/CA98/00496, filed on May 22, 1998.

(30) Foreign Application Priority Data

May 23, 1997 (CA) ..... 2206010

(51) Int. Cl.[7] ..... B66F 7/12
(52) U.S. Cl. ..... 254/894; 254/89 R
(58) Field of Search ..... 254/89 R, 89 H, 254/45

(56) References Cited

U.S. PATENT DOCUMENTS 2,640,562 * 6/1953 Villars ..... 254/89 R
2,958,508 11/1960 Martinez .
3,881,687 * 5/1975 Johansson ..... 254/89 H
3,958,664 * 5/1976 Perkins ..... 254/89 R
4,600,085 * 7/1986 Gagnon et al. ..... 254/89 R
4,793,593 12/1988 Pittman .
5,299,658 * 4/1994 Cox et al. ..... 254/89 H

* cited by examiner

*Primary Examiner*—David A. Scherbel
*Assistant Examiner*—Daniel Shanley
(74) *Attorney, Agent, or Firm*—Swabey Ogilvy Renault

(57) ABSTRACT

A universal lifting device for elevating heavy off-the-road vehicles, e.g. mechanical shovels used in mining operations, is proposed to raise the upper revolving section of the shovel and allow for its lower wheeled base to be removed with a view to attending to the maintenance, for instance, of the rotation mechanism of the shovel. The lifting device comprises front and rear lifting beams to which various type of brackets can be removably mounted to ensure a proper positioning of the front and rear lifting beams with respect to the revolving frame of different models of mechanical shovels. Front and rear lifting points are provided to control the vertical displacement of the front and the rear lifting beams, respectively. Typically, each such lifting point includes a pair of cylinders mounted in parallel fashion, an absolute lifting elevation detector and a piston stroke length detector which are connected to an automaton adapted to control the lifting operation of the revolving frame of the mechanical shovel.

27 Claims, 13 Drawing Sheets

HEAVY VEHICLE LIFTING DEVICE AND METHOD

CROSS REFERENCE

This application is a continuation of PCT/CA98/00496 filed May 22, 1998 designating the United States and claiming priority of Canadian Patent Application serial number 2,206,010 filed May 23, 1997.

TECHNICAL FIELD

The present invention relates to lifting mechanisms and, more particularly, to a lifting device which is adapted to elevate the revolving frame of a heavy mechanical shovel from its wheeled undercarriage.

BACKGROUND ART

Heavy vehicles, such as bucket wheel excavators or mechanical shovels, are subject to maintenance or repair work as, for instance, repairs to the ring gear of the turntable of a mechanical shovel which require that the revolving frame thereof, i.e. the upper part of the mechanical shovel, be lifted so as to disengage the same from the shaft gudgeon which extends at right angle from the center of the ring gear of the carbody, i.e. the lower part or undercarriage of the mechanical shovel. Accordingly, in a conventional method for lifting the revolving frame of a given mechanical shovel, a number of short stroke jacks mounted on steel support members are first disposed at the rear and at the front of the aforementioned mechanical shovel and, more particularly, under opposite ends of the revolving frame thereof. After an initial extension of the short stroke jacks, wood blocks are disposed at the rear and at the front of the revolving frame to thus hold up in position the revolving frame while the short stroke jacks are retracted and mounted on other wood blocks for a second lifting operation. Due to the short stroke of the jacks, the overall lifting operation is made in several steps, i.e. in a series of successive short lifting operations, and requires continuous provision of wood blocks.

With this method, it takes up to six days for lifting and lowering a large mechanical shovel. Moreover, the operators must work under the load during the lifting operation and there is thus a significant risk of accident, for instance, because this method does not provide a high degree of stability (e.g. the wood blocks can sometimes yield or at least be crushed under the high load being lifted). It is also noted that for some specific models of mechanical shovels (less than 600 tons), a 150-ton crane was used to lift the front portion of the revolving frame with a pair of 200-ton jacks being used at its rear portion. Consequently, a great portion of space available in the workshop was taken by the crane which also was mobilized for a number of days.

Furthermore, the above method cannot be used outside of the workshop since it is not adapted to compensate for the packing soil effect which could occur at the lifting point during the lifting operation of such heavy mechanical shovels.

DISCLOSURE OF INVENTION

It is therefore an aim of the present invention to provide a lifting device and method adapted to ensure the safe lifting of heavy equipment, such as the mechanical shovels used in the mining industry.

It is also an aim of the present invention to provide a lifting device which is adapted to increase the speed of the lifting operation.

It is a further aim of the present invention to provide such a lifting device which is designed for offering ease of assembly and disassembly. It is a still further aim of the present invention to provide a shovel lifting device which is adapted for lifting different models of shovels.

It is a still further aim of the present invention to provide a shovel lifting device which is easy to transport.

It is a still further aim of the present invention to provide a lifting device which can be used in or outside of a workshop.

Therefore, in accordance with the present invention, there is provided a shovel lifting device comprising front and rear lifting beams which are adapted to support the revolving frame of a given mechanical shovel, front and rear lifting means respectively adapted to control the vertical displacement of said front and rear lifting beams, said front and rear lifting means, when taken as a whole, comprising at least three lifting means, and connection means interconnecting said front and said rear lifting beams with said corresponding lifting means, whereby said revolving frame of said mechanical shovel can be lifted by operation of said lifting means of said shovel lifting device.

Also in accordance with the present invention, there is provided a shovel lifting device comprising a front and a rear lifting beams, each said front and said rear lifting beams being provided with at least one bracket means which is adapted to cooperate with a mechanical shovel having an upper part and a lower part to ensure a proper positioning of said front and said rear lifting beams with respect to said mechanical shovel, front and rear lifting means adapted to control the vertical displacement of said front and said rear lifting beam, wherein said front and said rear lifting beam comprise at least three lifting means, whereby said upper part of the shovel can be lifted by operation of said lifting means of said shovel lifting device Further in accordance with the present invention, there is provided a method of lifting heavy mechanical shovel using a shovel lifting device having front and rear lifting beam which are adapted to support the revolving frame of a given mechanical shovel, front and rear lifting means respectively adapted to control the vertical displacement of said front and rear lifting beam, wherein said front and rear lifting means, when taken as a whole, comprising at least three lifting means, the method comprising the following steps:

a) preparing a lifting area and the mechanical shovel;

b) installing said rear and said front lifting beams with said corresponding lifting means thereof at the appropriate location with respect to the mechanical shovel; and c) lifting the mechanical shovel in a single step by operation of said lifting means.

Still further in accordance with the present invention, there is provided a method of lifting heavy mechanical shovel using a shovel lifting device having front and rear lifting beam which are adapted to support the revolving frame of a given mechanical shovel, front and rear lifting means respectively adapted to control the vertical displacement of said front and rear lifting beam, wherein said front and rear lifting means, when taken as a whole, comprising at least three lifting means, said lifting means being provided with detector means which are adapted to determine the length stroke and/or the absolute lifting elevation of the mechanical shovel at each of said lifting means, the method comprising the following steps:

a) preparing a lifting area and the mechanical shovel;

b) installing said rear and said front lifting beams with said corresponding lifting means thereof at the appropriate location with respect to the mechanical shovel;

c) mounting said detector means to said lifting means;

d) recording the reference lifting plan; and e) lifting the mechanical shovel by operation of said lifting means.

Still further in accordance with the present invention, there is provided a method of lifting heavy mechanical shovel using a shovel lifting device comprising two lifting beams, removable bracket means being adapted to be mounted to said lifting beams, front and rear lifting means respectively adapted to control the vertical displacement of said front and rear lifting beam, said front and rear lifting means comprising at all at least three lifting means, said lifting means being provided with removable detector means which are adapted to determine the length stroke and/or the absolute lifting elevation of the mechanical shovel at each of said lifting means, the method comprising the following steps:

a) preparing a lifting area and the mechanical shovel;

b) if required, mounting said removable bracket means associated with the mechanical shovel to be lifted to said lifting beams;

c) installing said rear and said front lifting beams with said corresponding lifting means thereof at the appropriate location with respect of the mechanical shovel;

d) mounting said detector means to said lifting means;

e) recording the reference lifting plan; and f) lifting the mechanical shovel by operation of said lifting means.

BRIEF DESCRIPTION OF THE DRAWINGS

Having thus generally described the nature of the invention, reference will now be made to the accompanying drawings, showing by way of illustration a preferred embodiment thereof and in which.

MODES FOR CARRYING OUT THE INVENTION

Figure 1:
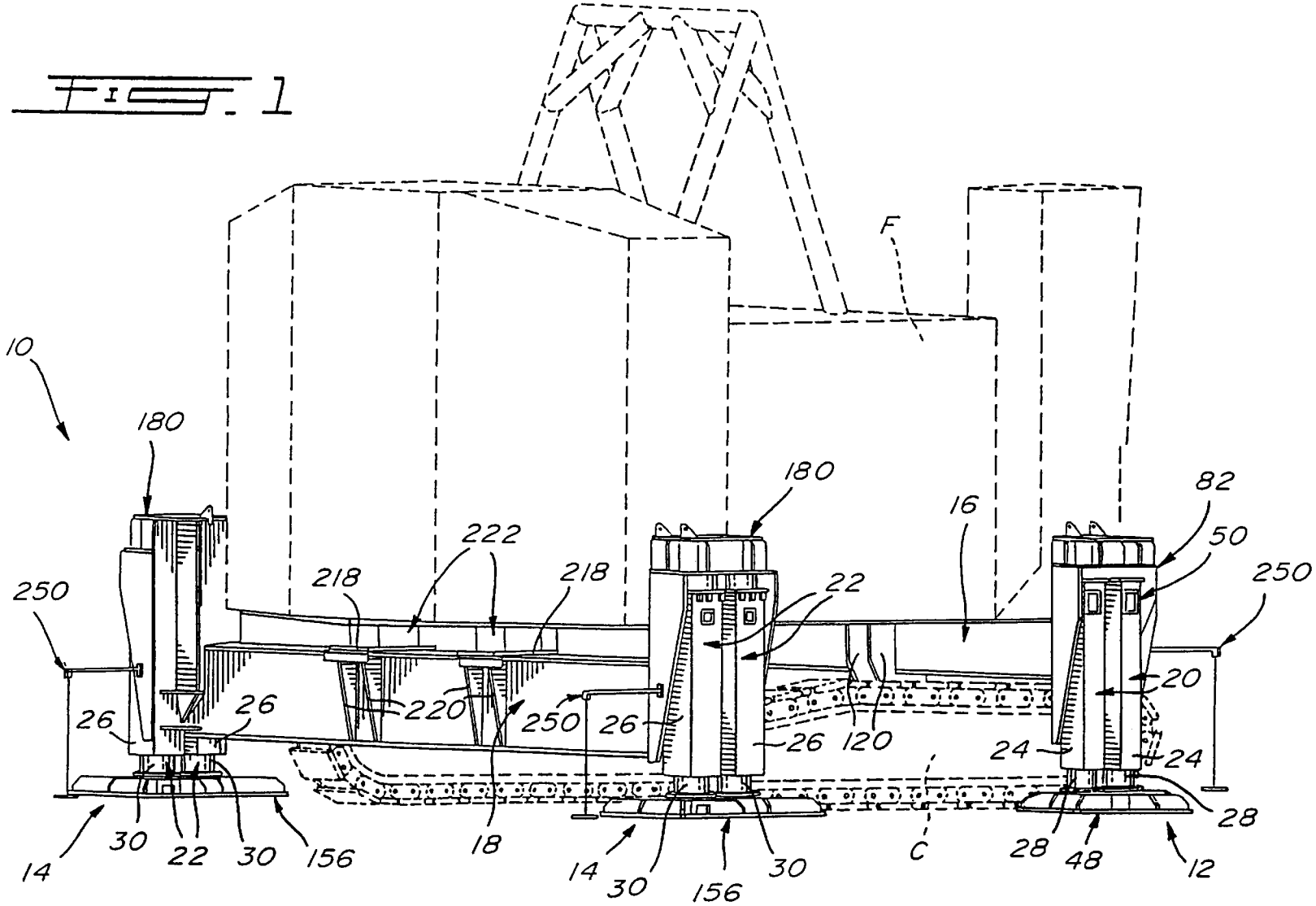
FIG. 1 is a perspective view taken at a slight angle to the horizontal of a shovel lifting device in accordance with the present invention shown in the process of lifting the revolving frame of a large mechanical shovel which is shown in broken lines.

In accordance with the present invention, FIG. 1 illustrates a shovel lifting device 10 which is used to lift the revolving frame F of a mechanical shovel so as to disengage the revolving frame F from the shaft gudgeon which extends at right angle from the center of the ring gear of the undercarriage or carbody C of the shovel to allow for repairs thereof.

More specifically, the shovel lifting device 10 includes two front lifting units 12 and two rear lifting units 14 which are respectively located at opposed ends of front and rear lifting beams 16 and 18 which are adapted to be secured respectively under the front and rear ends of the revolving frame F of a given mechanical shovel. The shovel lifting device 10 further includes an hydraulic control unit (not shown) which is located outside of an established security perimeter to eliminate the necessity of having operators under or near the load during the lifting operation. Therefore, the chances of accident during the operation of the shovel lifting device 10 are greatly reduced.

Figure 5:
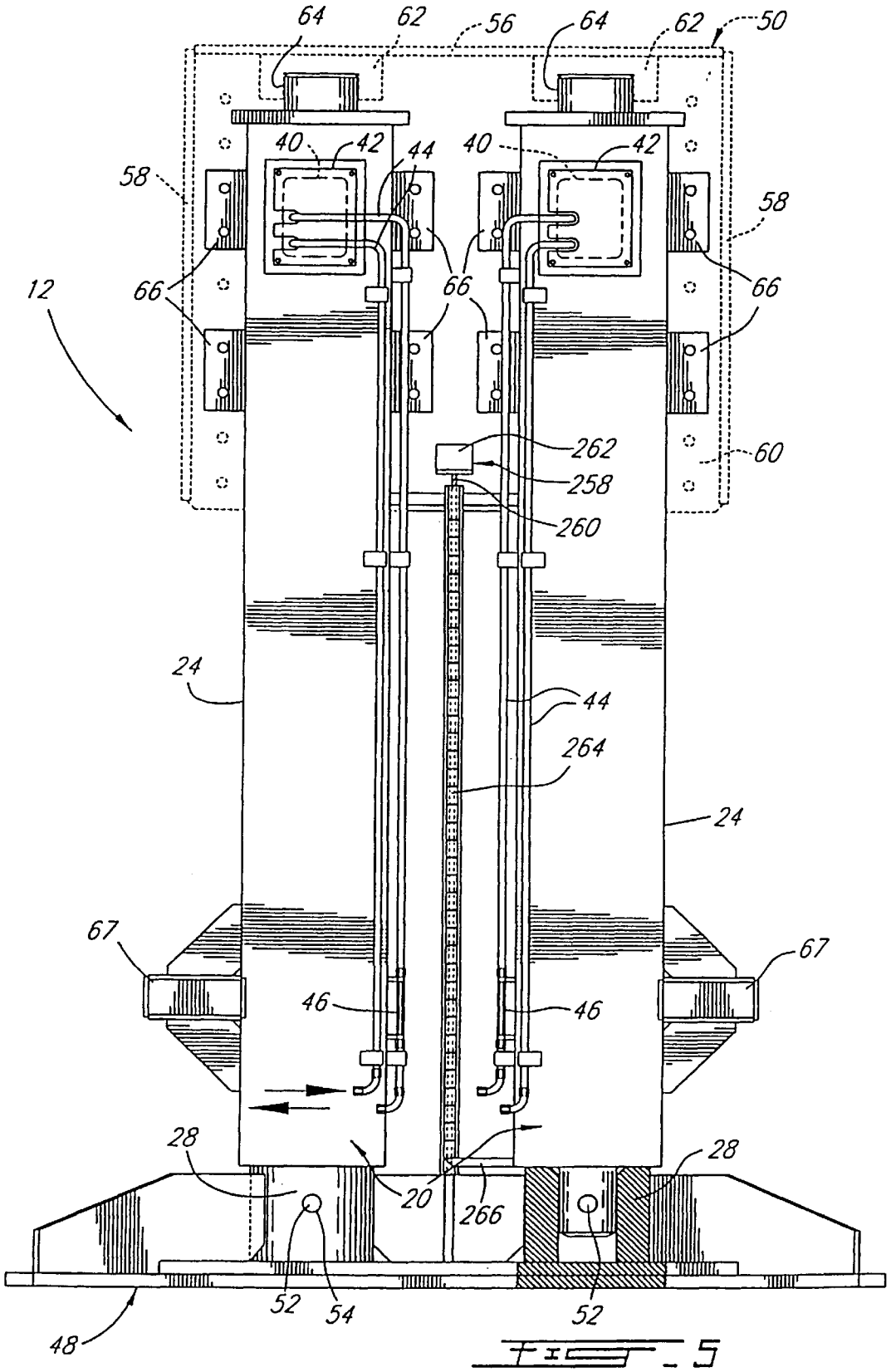
FIG. 5 is a front elevational view partly in cross-section of a pair of front cylinders, a front base structure and a front mounting box of one of the front lifting units.
Figure 7:
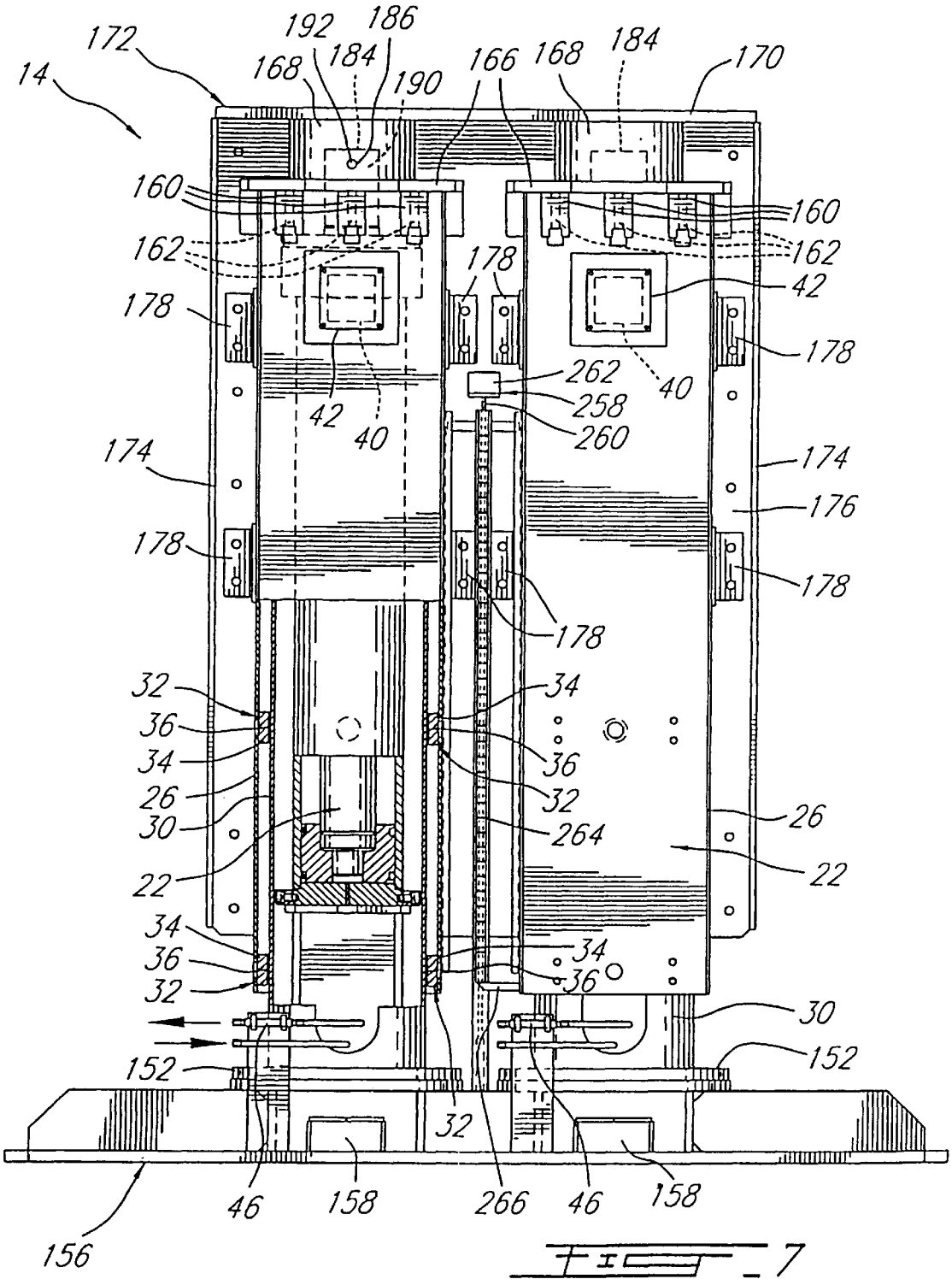
FIG. 7 is a front elevational view partly in cross-section of a pair of rear cylinders, a rear base structure and a rear mounting box of one of the rear lifting units.

It is seen from FIGS. 5 and 7 that each front lifting units 12 includes a pair of front hydraulic cylinders 20 which are connected in a parallel fashion. Similarly, each rear lifting unit 14 includes a pair of parallel rear hydraulic cylinders 22. Each front and rear cylinder 20 and 22 of a pair of cylinders is adapted for retaining the load in the event of a failure of the other front or rear cylinder 20 and 22 of the same pair. It is noted that the front and the rear cylinders 20 and 22 have all the same stroke and that they include an outer square casing 24 and 26, respectively, which is slidably mounted on an inner casing 28 and 30 of an annular cross section. As illustrated in FIG. 7, each outer square casing 26 includes two self lubricating bearings 32. Each such bearing 32 comprises four plates 34 which are each provided with an hydraulic lubricator 36 and which each have an inner arched side. These plates 34 are mounted to the four inner sides of the outer square casing 24 and 26 so as to define a circular opening which generally corresponds to the outside diameter of the inner casing 28 and 30.

This allows for a proper relative telescopic motion between the outer square tubular casings 24 and 26 and the inner casings 28 and 30. This double casing configuration, i.e. each outer square casing 24 and 26 with its respective inner casing 28 and 30, provides a better resistance to lateral loads which may be induced either by the load supported by the front and rear beams 16 and 18 or by the wind and the packing soil effect when the shovel lifting device 10 is used outside of the workshop. It is noted that the double hydraulic cylinder configuration of each front and rear lifting units 12 and 14 also contributes to improve the side load capacity of the overall shovel lifting device 10.

A safety valve (not shown) is mounted at the inlet of each front and rear cylinders 20 and 22 to ensure that the load will be held up in the event of an accidental loss of pressure in the hydraulic circuit. Each safety valve is accessible via an opening 40 defined in the casing of each front and rear cylinders 20 and 22. This opening 40 is provided with a bolted plate 42 through which extend the feed and return flexible conduits 44 which are used to connect each front and rear cylinder 20 and 22 to the hydraulic control unit (not shown). As best seen in FIG. 5, the flexible conduits 44 are secured on the side of each outer square casing 24 and 26 and are provided at the bottom thereof with an oil flow indicator 46 which allows for visual inspection of the flow of oil leaving each front and rear cylinder 20 and 22.

Figure 6:
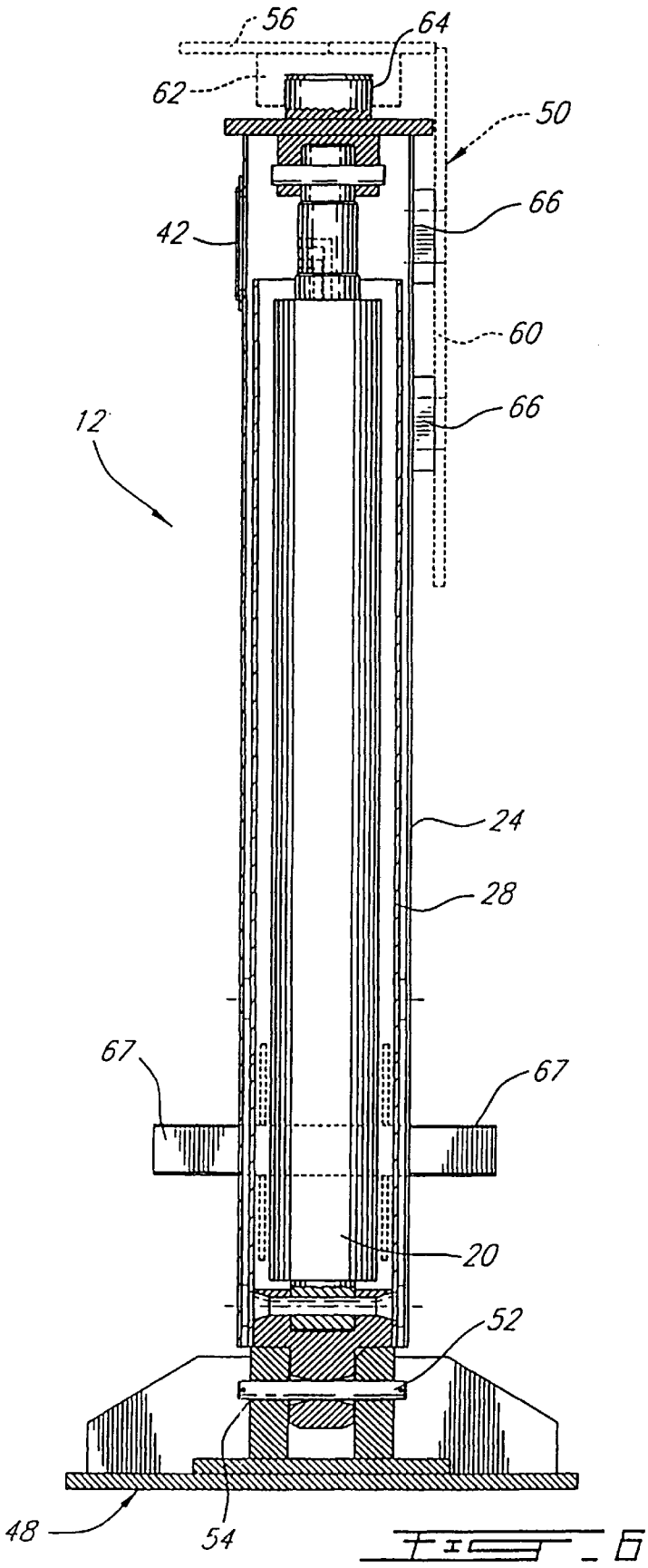
FIG. 6 is a vertical cross-sectional view of one of the front cylinders.

More particularly, each pair of front cylinders 20 is respectively mounted at the bottom end thereof to a front base structure 48 and at the upper end thereof to a front mounting box 50 to ensure the stability of the shovel lifting device 10 and to allow for the joint operation of the front cylinders 20 of each front lifting unit 12. As seen in FIGS. 5 and 6, the front cylinders 20 of each front lifting unit 12 are each secured to the front base structure 48 by means of a coupling pin 52 which is introduced in openings 54 defined in the front base structure 48 and in the hole (not shown) extending through the bottom end of the inner circular casing 28 of each front cylinder 20.

Figure 2:
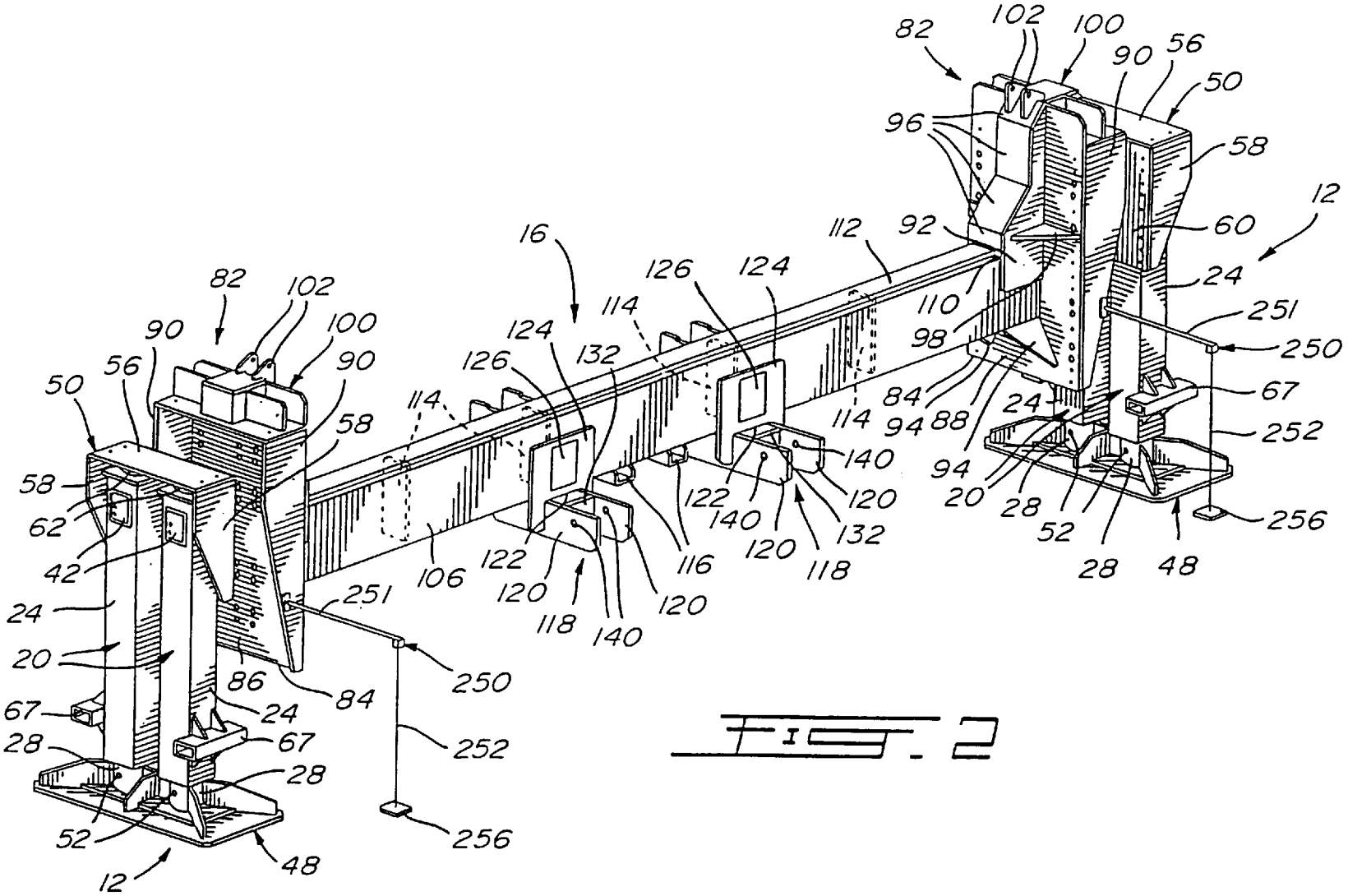
FIG. 2 is a partly exploded perspective view of a front lifting assembly comprised of a pair of front lifting units and a front lifting beam of the device of FIG. 1.

As shown in FIGS. 2, 5 and 6, the front mounting box 50 includes a head plate 56, two side plates 58 extending at right angles from the underside of the head plate 56 and a mounting plate 60 which is welded to the back edge of the head plate 56 and to the side plates 58. The underside of the head plate 56 is provided with two cylindrical protuberances 62 having respective coaxial recesses 64 which receive the head of the pistons of a given pair of front cylinders 20. As best seen in FIGS. 5 and 6, the mounting plate 60 of the front mounting box 50 is bolted to mounting plates 66 which extend at right angles from the outer square casing 24 of the front cylinders 20 to thus secure each front mounting box 50 to its corresponding pair of front cylinders 20. Therefore, once the front mounting boxes 50 have been mounted on the head of the pistons of the front cylinders 20 and secured to their corresponding outer square casings 24, the latter can be moved by operation of the front cylinders 20 associated therewith. Moreover, each front lifting unit 12 can be handled as an integral assembly, for instance (when possible), by a forklift which engages fork receiving openings 67 extending horizontally on the exterior surface of both outer square casings 24 of each pair of front cylinders 20.

Figure 4:
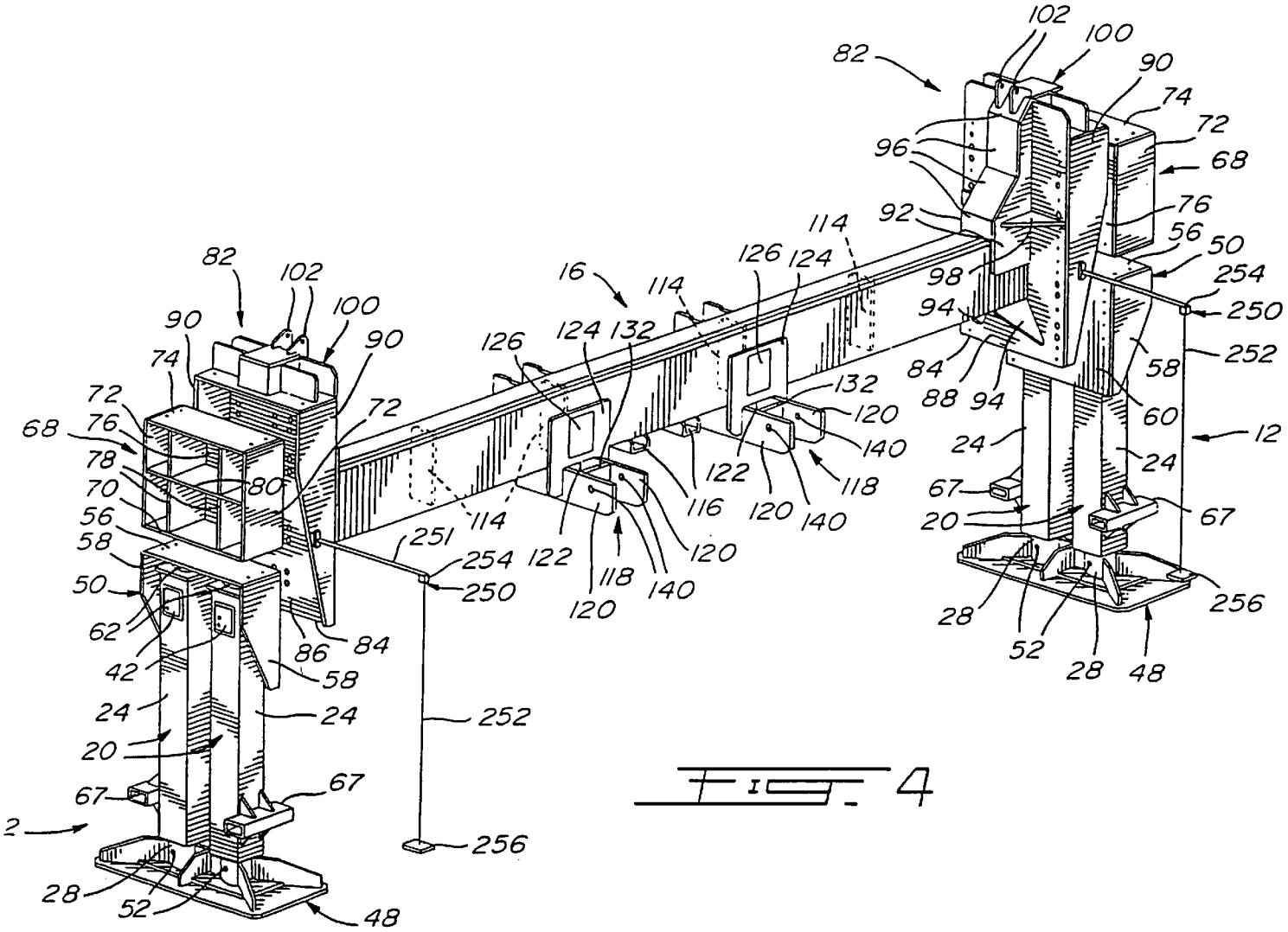
FIG. 4 is a partly exploded perspective view of the front lifting assembly with a spacing block mounted on each front lifting units.

In some cases, a spacing block 68, such as the one illustrated in FIG. 4, needs to be mounted on the head plate 56 of the front mounting box 50 of each front lifting units 12 in order to compensate for lost motion in the stroke of the front cylinders 20 depending on the model of mechanical shovel being lifted. Indeed, some models of mechanical shovels, for instance the P&H 2100 BLE and 2300 XPA, are provided with front and rear supporting points which are not at the same elevation. More particularly, for these models of shovels, the rear supporting points to which the rear lifting beam 18 is in contact with are at a lower elevation than the front supporting points to which the front lifting beam 16 is anchored and, since the front and the rear cylinders 20 and 22 have the same stroke, a preliminary extension of the front cylinders 20 is required and thus the stroke of the front cylinders 20 which is available for the lifting operation of the mechanical shovel is reduced. Therefore, the spacing block 68 is used to compensate the difference in heights that exists between the front and the rear supporting points of some mechanical shovels and thus allows for a full use of the available stroke of the front cylinders 20 for the lifting operation. It is noted that the spacing blocks 68 are not required when the difference in height between the front and the rear supporting points of the mechanical shovel does not constitute an obstacle to the disengagement of the shaft gudgeon from the revolving frame F of the shovel, that is to say that the available length of stroke of the front cylinders 20 is sufficient enough to ensure that the carbody C is totally disengaged from the revolving frame F of the mechanical shovel and thus allows for the displacement of the carbody C.

With reference to FIG. 2, each spacing block 68 comprises a bottom plate 70, two side walls 72 extending at right angles therefrom, a top plate 74 and a beam mounting plate 76. The spacing block 68 further comprises two vertical reinforcement plates 78 which extend between the bottom 70 and the top plates 74 and three horizontal reinforcement plates 80 which extend between the side walls 72 and the vertical reinforcement plates 78 to ensure a proper resistance to side loads. The bottom plate 70 of each spacing block 68 is bolted to the head plate 56 of each front mounting box 50.

Therefore, depending on whether or not the spacing block 68 is required, the front lifting beam 16 will be mounted to the beam mounting plate 76 of each spacing block 68 or to the mounting plate 60 of each front mounting box 50. Indeed, the front lifting beam 16 is provided at each end thereof with a beam connection member 82 which is adapted to secure the front lifting beam 16 to each front lifting point 12 so that the front lifting beam 16 will be raised or lowered by operation of each pair of front cylinders 20. With reference to FIGS. 2 and 4, each beam connection member 82 of the front lifting beam 16 includes a mounting plate 84 having front and rear surfaces 86 and 88 and a bolting pattern which corresponds to the bolting pattern of either the beam mounting plate 76 of the spacing blocks 68 or the mounting plate 60 of the front mounting boxes 50. Each beam connection member 82 of the front lifting beam 16 also includes two side walls 90 which extend at right angles from the periphery of the front surface 86 of the aforementioned mounting plate 84, the side wall 90 being adapted to receive either the side walls 72 of the spacing block 68 or the side plates 58 of the front mounting box 50. Each beam connection member 82 further includes two lateral beam supporting plates 92 and two lower beam supporting plates 94 extending at right angles from the rear surface 88 of the mounting plate 84 and being adapted to receive one end of the front lifting beam 16. Therefore, each end of the front lifting beam 16 is introduced between the two lateral beam supporting plates 92 so as to be supported at their lower corners by the two lower beam supporting plates 94. Thereafter, each end of the front lifting beam 16 is secured to its associated beam connection member 82. In order to reinforce the lateral support offered by the two lateral beam supporting plates 92, four plates 96 are welded to the corresponding edges of each lateral beam supporting plate 92. The lateral support is also reinforced by two horizontal plates 98 extending from the rear surface 88 of the mounting plate 84 and on the outside of each lateral beam supporting plate 92, the plates 98 extending at right angles to each lateral beam supporting plate 92 of the beam connection member 82 and to the rear surface 88 of the mounting plate 84. Each beam connection member 82 of the front lifting beam 16 further includes a top member 100 provided with two lugs 102 which may be used to handle the front lifting beam 16, for instance with a crane.

Figure 9:
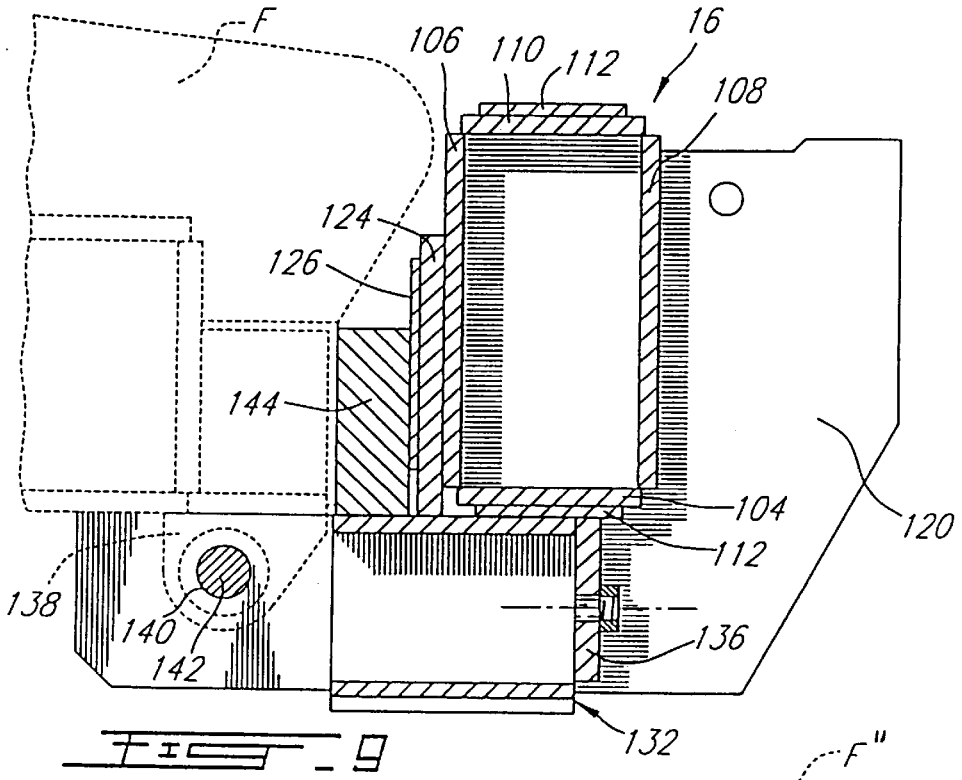
FIG. 9 is a cross-sectional view of the front lifting beam illustrating how the lifting arms thereof secure the front lifting beam to the revolving frame of the mechanical shovel.

Now referring to FIGS. 2 and 9, the front lifting beam 16 consists of a bottom plate 104, a front plate 106, a rear plate 108 and a top plate 110 all welded together so as to form a rectangular tubular beam. The bottom plate 104, the front plate 106, the rear plate 108 and the top plate 110 are all 1½ inch thick and made of steel. The exterior sides of the bottom and top plates 104 and 110 are each lined throughout their length with a reinforcement plate 112 having a thickness of one inch. Four reinforcement plates 114 extending at right angles between the inside surface of the top 110, the bottom 104, the front 106 and the rear plates 108 are uniformly distributed along the length of the front lifting beam 16 to improve the resistance thereof to torsion. Two fork receiving openings 116 are provided on the reinforcement plate 112 of the bottom plate 104 for handling purposes of the front lifting beam 16.

As best seen in FIGS. 2, 4 and 9, the front lifting beam 16 is also provided with a pair of lifting arms 118 which are adapted to secure the front lifting beam 16 to different models of mechanical shovels. Each lifting arm includes a pair of spaced apart L-shaped plates 120 which are welded to the exterior surface of the rear plate 108 and to the reinforcement plate 112 of the bottom plate 104. The front portion of each pair of L-shaped plates 120 extends through the square notch 122 defined at the bottom of a plate 124 which is welded to the front plate 106 of the front lifting beam 16 and to which a rectangular plate 126 is also welded.

Figure 10:
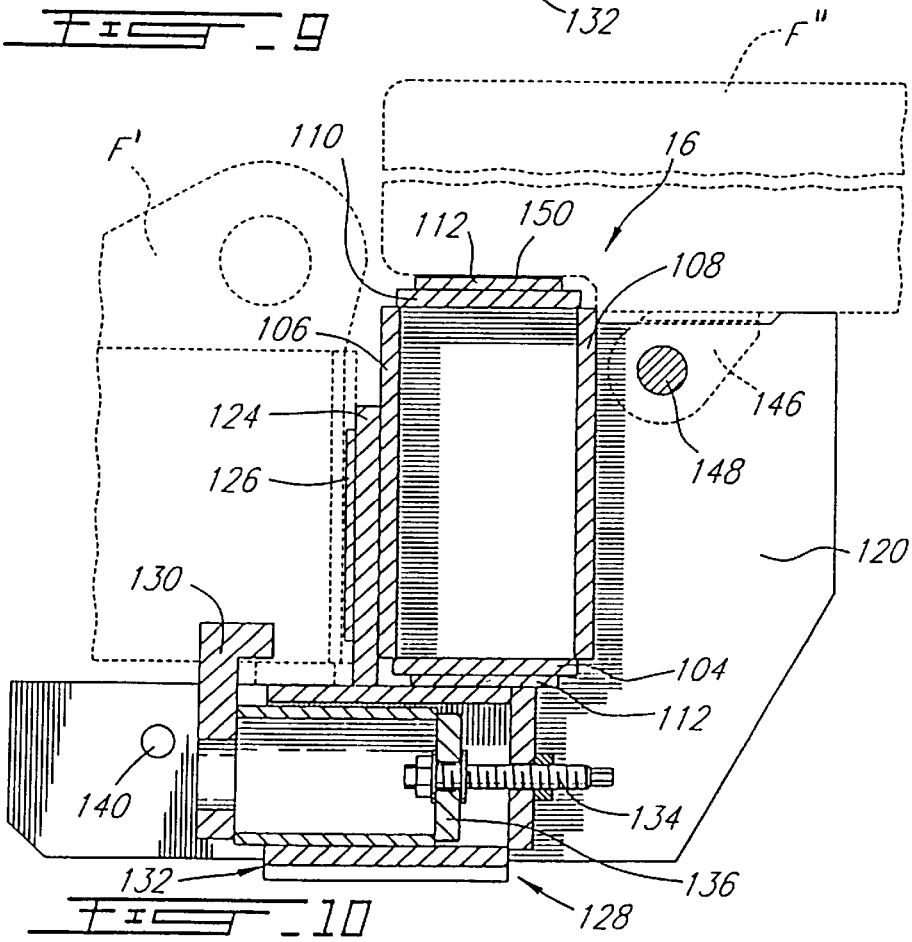
FIG. 10 is a cross-sectional view of the front lifting beam and of its moveable hook assembly which illustrates how the front lifting beam can be secured to the revolving frames of a different mechanical shovel, two such other shovels being herein shown.

As shown in FIG. 10, a moveable hook assembly 128 mounted between the L-shaped plates 120 of each lifting arm 118 includes a hook 130 which is moveable within a guide casing 132 by operation of a bolt 134 which is mounted to a rear plate 136 of the guide casing 132 and to the hook 130 itself. Therefore, the hook assemblies 128 are used to secure the front lifting beam 16 to the bottom plate of the revolving frame F' of certain types of shovels, such as the P&H 2300 XPA shovel. It is noted that, in FIG. 9, the same side of the front lifting beam 16 is used for the lifting operation of the P&H 2100 BLE shovel, but that no moveable hook assemblies 128 are required in the case of the shovel of FIG. 9.

In the case of the model of mechanical shovel of FIG. 9, the attachment of the front lifting beam 16 is ensured by way of two pairs of spaced apart lugs 138, also referred to as supporting points, welded on the underside of the revolving frame F of the mechanical shovel and which are adapted to be introduced between each corresponding lifting arm 118 so that the lugs 138 will be aligned with openings 140 defined in the front portion of each pair of L-shaped plates 120 for allowing for the insertion of coupling pins 142. It is also noted that two spacing plates 144, one for each lifting arm 118 and having a thickness of 6 inches, are required to ensure the positioning and the support of the front lifting beam 16 on the front of the P&H 2100 BLE shovel of FIG. 9. More particularly, each spacing plate 144 is supported at the bottom thereof by the top of the guide casing 132.

Finally, the revolving frame F" (see FIG. 10) of the B-E 295BI and 295BII shovel models are mounted in the same manner as the P&H 2100 BLE of FIG. 9, but in this case, to the rear side of the front lifting beam 16 and, more particularly, to the rear portion of the L-shaped plates 120, as illustrated in FIG. 10. It easily seen that the front lifting beam 16 is secured to these models of mechanical shovels by means of lugs 146 and coupling pins 148. However, the B-E295 BI and 295BII models require the use of wedges 150 to fill the space between the top surface of the front lifting beam 16 and the underside of the revolving frame F" of the shovel to provide an appropriate supporting surface once the front lifting beam 16 has been positioned. This will thus contribute to ensure that the lifting surface is level and that no shearing stress is induced on the coupling pins 148 during the lifting operation.

As previously mentioned, the rear lifting units 14 are similar to the front lifting units 12 in that each rear lifting unit 14 is formed of a pair of rear cylinders 22, each rear cylinder 22 being provided with an outer square casing 26 which is slidably mounted on an inner casing 30 having a circular cross section. However, the rear cylinders 22 are adapted to support and lift bigger loads than the front ones. For instance, the front and rear lifting beams 16 and 18, respectively, have respective capacities of 150 tons and 500 tons, with the rear lifting beam 18 being positioned slightly in front of the shovel's counterweight, whereby counterbalancing principles are used to reduce the load on the front lifting beam 16. Thus, the lifting capacity required to lift a mechanical shovel is greater at the rear than at the front thereof.

Figure 8:
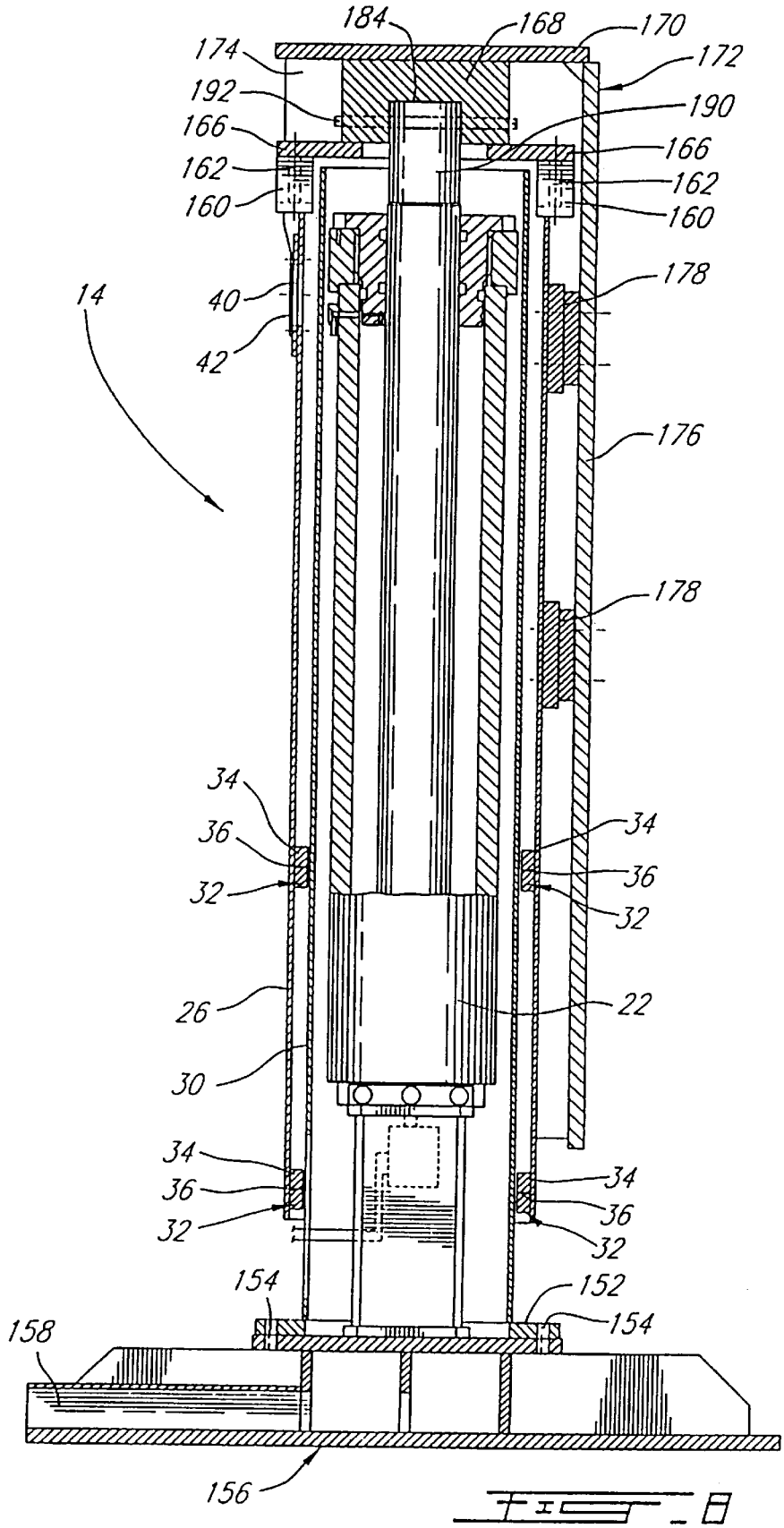
FIG. 8 is a vertical cross-sectional view of one of the rear cylinders.

Accordingly, the front and rear cylinders 20 and 22 are respectively 9 and 12½ inches in diameter and have a 66-inch stroke. Moreover, as shown in FIGS. 7 and 8, the inner casing 30 of each rear cylinder 22 is provided at the lower end thereof with a flange 152 which has eight screw holes 154 uniformly distributed on the periphery thereof for mounting each rear cylinder 22 to its corresponding rear base structure 156. The rear base structure 156 of each rear lifting units 14 is provided with two fork receiving openings 158 for handling purposes. Therefore, when each pair of rear cylinders 22 has been mounted to its respective rear base structure 156, both rear lifting units 18 can be handled by the fork openings 158 defined in the rear base structures 156. As best seen in FIGS. 7 and 8, each outer square casing 26 is provided at an upper end thereof with a plurality of peripheral connection plates 160 having holes 162 which correspond to the screw holes defined in the flanges 166 of both cylindrical protuberances 168 extending downwardly from the head plate 170 of each rear mounting box 172. Therefore, as for the front lifting units 12, a rear mounting box 172 is mounted on each pair of rear cylinders 22. The rear mounting boxes 172 are quite similar to the front ones in that they comprise a head plate 170, two side plates 174 extending laterally from the underside of the head plate 170 and a mounting plate 176 extending at right angles from the head plate 170 between the two side plates 174, the mounting plate 176 being adapted to cooperate with the mounting plates 178 extending at right angles from the exterior surface of each outer square casing 26 and with the beam connection members 180 of the rear lifting beam 18. The side plates 174 of the rear mounting boxes 172 are strengthened by horizontal and vertical reinforcement plates 182 mounted thereon. As mentioned above, the head plate 170 of each rear mounting box 172 is provided with two cylindrical protuberances 168, each protuberance 168 having a circular recess 184 for receiving the head of the piston of a given rear cylinder 22 and having a transversal hole 186 which is adapted to be aligned with the hole defined in the head of each piston 190 to allow for the insertion of a coupling pin 192. Therefore, once the rear mounting box 172 has been properly mounted to the head of both pistons 190 of a given pair of rear cylinders 22 and to the outer square casings 26 associated therewith, the latter can be displaced by operation of the rear cylinders 22.

It is seen from FIG. 2 that, like the front lifting beam 16, the rear lifting beam 18 is provided at each end thereof with a beam connection member 180 which includes a mounting plate 194 having front and rear surfaces 196 and 198 and which defines a bolting pattern corresponding to the bolting pattern of the mounting plate 176 of the rear mounting boxes 172. This ensures an easy and quick mounting of the rear lifting beam 18 to both rear lifting units 14. The beam connection members 180 of the rear lifting beam 18 further each include two side walls 200 which extend laterally from the front surface 196 of the mounting plate 194, beam supporting members 202 extending from the rear surface 198 of the mounting plate 194 and a top member 204 provided with two lugs 206 which may be used to handle the rear lifting beam 18.

Figure 3:
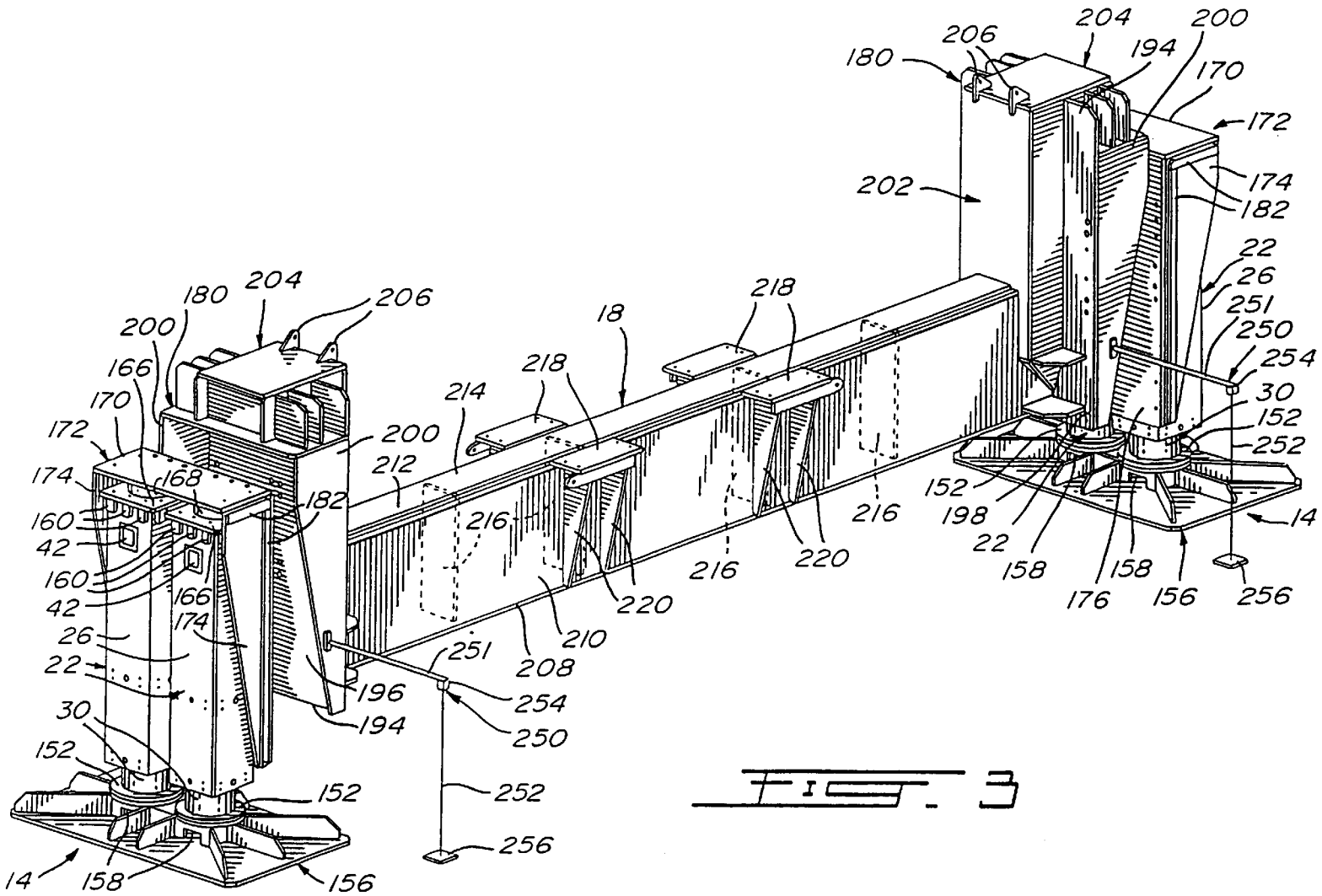
FIG. 3 is a partly exploded perspective view of a rear lifting assembly comprised of a pair of rear lifting units and a rear lifting beam of the device of FIG. 1.
Figure 12:
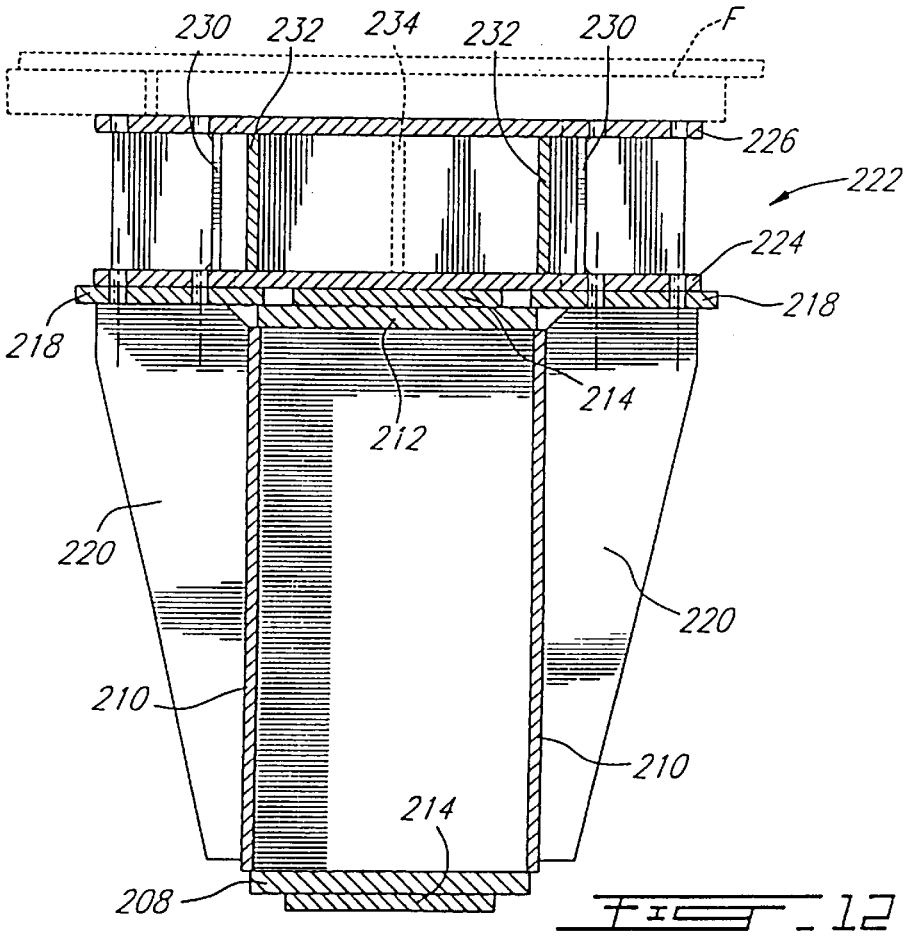
FIG. 12 is a cross-sectional view taken along lines 12—12 of FIG. 11 and showing the horizontal bracket which is removably mounted to the rear lifting beam.
Figure 14:
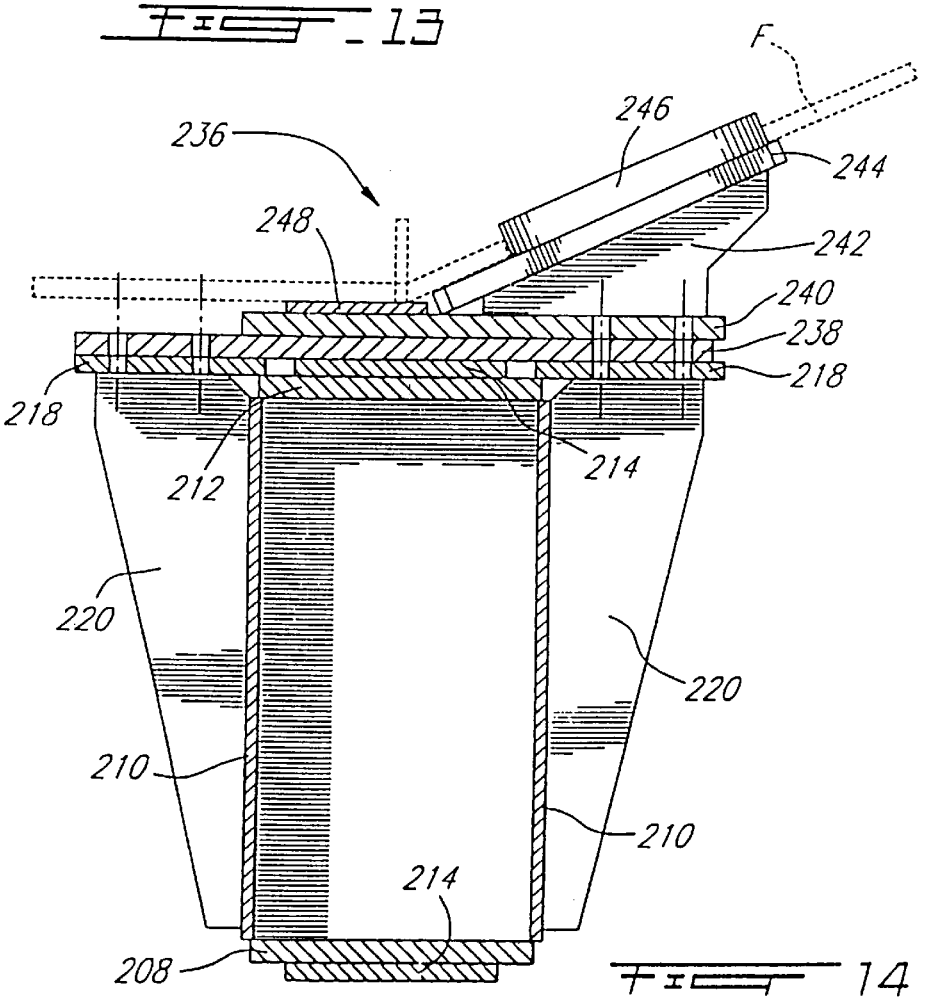
FIG. 14 is a cross-sectional view taken along lines 14—14 of FIG. 13 and showing the inclined bracket which is removably mounted to the rear lifting beam.

As illustrated in FIGS. 3, 12 and 14, the rear lifting beam 18 consists of a bottom plate 208, two side plates 210 and a top plate 212 all welded together so as to form a rectangular tubular beam. The bottom and the top plates 208 and 212 are one inch thick while the side plates are two inches thick. The exterior sides of the bottom and the top plates 208 and 212 are each respectively lined throughout their length with a reinforcement plate 214 having a thickness of 1½ inch. Four reinforcement plates 216 extend at right angles between the inside surface of the top 212, the bottom 208 and the side plates 210 and are uniformly distributed along the length of the rear lifting beam 18 to improve the torsion resistance thereof. The rear lifting beam 18 is also provided with two pairs of connection plates 218 which are welded on the top plate 212 of the rear lifting beam 18 and which allow for the bolting of various types of brackets used to support the rear portion of the revolving frame F of different models of mechanical shovels. Each connection plate 218 is further supported on the underside thereof by a pair of plates 220 extending at right angles from the side plates 210 of the rear lifting beam 18.

Figure 11:
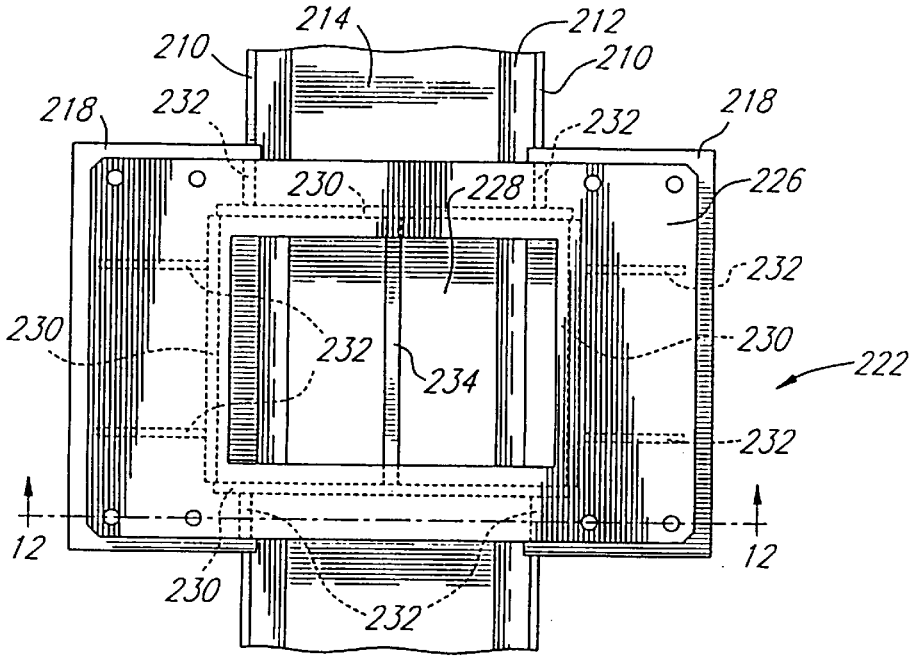
FIG. 11 is a top plan view of a horizontal bracket which is removably mounted to the rear lifting beam.

As seen in FIGS. 11 and 12, each pair of connection plates 218 allows for the bolting of an horizontal bracket 222 which is adapted to support the underside of the counterweight which is mounted to the rear of the B-E295 BII shovel. Each horizontal bracket 222 comprises bottom and top plates 224 and 226 which have a rectangular opening 228 defined in the center thereof, the bottom and the top plates 224 and 226 being spaced apart by four spacing plates 230 mounted in a rectangular configuration around the aforementioned rectangular opening 228 and by two plates 232 extending at right angles outwardly from each spacing plate 230. Each horizontal bracket 222 further comprises a reinforcement plate 234 extending in the center of the rectangular opening 228 and, more particularly, between the two spacing plates 230 which are transversal with respect to the rear lifting beam 18.

Figure 13:
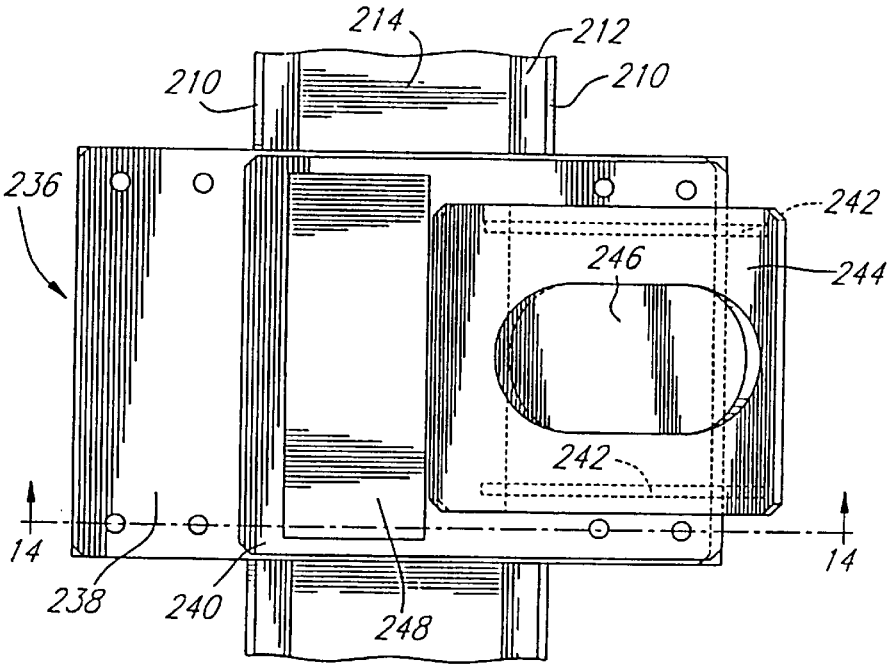
FIG. 13 is a top plan view of an inclined bracket which is removably mounted to the rear lifting beam.

As seen from FIGS. 13 and 14, each pair of connection plates 218 also permits for the installation of an inclined bracket 236 which is adapted to support the rear corners of the revolving frame F of the P&H 2300 XPA shovel. Each inclined bracket 236 comprises first and second base plates 238 and 240 which are welded together in a staggered fashion, the base plates 238 and 240 defining a bolted pattern which allows for the bolting of a given inclined bracket 236 to a pair of connection plates 218 of the rear lifting beam 18. Each inclined bracket 236 further comprises a pair of spaced apart inclined supports 242 which extend at right angles from the upper surface of the second base plate 240, a rectangular plate 244 which is mounted to both inclined supports 242 so as to form an inclined supporting surface from which extends substantially at right angles an obround plate 246 having opposite semi-circular ends, the plate 246 being adapted to engage the holes defined in the rear underside of the revolving frame F' of the P&H 2300 XPA shovel so as to determine the lifting axle of the rear lifting beam 18. Some wedges 248 must be used to fill the space between the horizontal portion of the second base plate 240 and the underside of the revolving frame F' of the P&H 2300 XPA shovel.

From the above, it is easily seen that the configuration of the rear lifting beam 18 allows for the installation of various types of bracket which are designed for different models of mechanical shovels. However, it is noted that some models of mechanical shovels, as for instance the P&H 2100 BLE, do not require the provision of such brackets. Indeed, the P&H 2100 BLE shovel is directly supported by the rear lifting beam 18, the space between both pairs of connection plates 218 being filled up by wedges so as to offer an uniform supporting surface. Therefore, the connection plates 218 of the rear lifting beam 18 and the wedges act as a bracket; in other words, they form a support for the revolving frame F of the mechanical shovel.

The shovel lifting device 10 is also provided with means to determine the length stroke of each cylinder and the absolute lifting elevation of the shovel at any time during the lifting operation. These detectors are adapted to transmit their respective information to an automaton which is used to control the lifting operation.

More specifically, as best seen in FIGS. 2 and 3, each front and rear lifting units 12 and 14 are provided with a removable absolute lifting elevation detector assembly 250 including an absolute lifting elevation detector 254 which is mounted to the end of member 251 which extends at right angles from one of the side walls 90 and 200 of each beam connection member 82 and 180 of the front and the rear lifting beams 16 and 18, respectively. A cable 252 is secured at one end thereof to the absolute lifting elevation detector 254 and at an opposite end thereof to a plate 256 which is anchored in the soil. The cable 252 must be perpendicular with respect to the absolute elevation detector 254 and the member 251 must be long enough to ensure that the plate 256 which is anchored in the soil will not be subjected to the packing soil effect. This allows for an accurate determination of the elevation of the revolving frame F of the mechanical shovel with respect to the soil during the lifting operation.

As best seen in FIGS. 5 and 7, each front and rear lifting units 12 and 14 are also provided with a removable stroke length detector assembly 258 which is mounted to a respective mounting plate 60 and 176 of its mounting box 50 and 172, respectively. More particularly, a cable 260 is secured at one end thereof to a stroke length detector 262 and at an opposite end thereof to the base structure 48 and 156 of the front and rear cylinders 20 and 22, respectively. The cable 260 is protected by a vertical guard 264 to prevent alteration of the position of the cable 260 during the lifting operation. The stroke length detector 262 is adapted to measure the stroke of each pair of front and rear cylinders 20 and 22 which will be greater than the absolute lifting elevation if the soil gives way under the front and the rear lifting units 12 and 14. In order to facilitate the supervision of the lifting operation, a scale is installed on the vertical guard 264 and a pointer 266 is secured to the bottom side of the outer square casing 24 and 26 to give a visual indication of the stroke of the front and the rear cylinders 20 and 22 at any time during the lifting operation.

The hydraulic control unit (not shown) used in conjunction with the front and the rear lifting units 12 and 14 consists of a feed pump having a differential flow and operating at constant pressure with each pressure line thereof being provided with a flow regulator and with a directional valve. More particularly, a main line feeds a junction manifold on which the four directional valves and flow regulators are installed. Each directional valve feeds a pair of front or rear cylinders 20 and 22, whereby the manifold is provided with two feed and two return lines for the front cylinders 20 and with two feed and two return lines for the rear cylinders 22. The return flow passes through a filter and an oil cooler and finally returns to an oil tank. The hydraulic control unit also comprises a recirculation pump which is used to warm up the oil before the lifting operation. A spare valve is mounted in parallel fashion with each directional valve such that it can be used in the event of a failure of the valve which is normally in operation.

Accordingly, the fact that each front and rear lifting unit 12 and 14 is independently controlled, allows for the revolving frame F of a given mechanical shovel to be fitted and this is particularly useful during the re-engagement operation of the shaft gudgeon of the carbody C with the revolving frame F. This operation is also greatly facilitated by the automaton which has recorded the initial position of the revolving frame F of the mechanical shovel before the lifting operation and which is adapted to control all the operations. Moreover, the configuration of the hydraulic system and the joint use of the automaton which is connected to the absolute lifting elevation and stroke length detectors 254 and 262 of each front and rear lifting unit 12 and 14 ensure a uniform lifting plane, even if the front and rear lifting units 12 and 14 are not at a same level. Therefore, the present shovel lifting device 10 is adapted to maintain the initial lifting plane which is computed by the automaton before the lifting operation. Accordingly, the hydraulic control unit allows to have the same lifting speed at each front and rear lifting unit 12 and 14 during the complete lifting or lowering operation.

Having thus described the structure of the present invention, we will now explain the general method for lifting different models of mechanical shovels, such as the P&H 2300 XPA, the P&H 2100 BLE and the B-E295 BI, 295BII

First, it is necessary to prepare the lifting area. More particularly, when the shovel lifting device 10 is used outside of the workshop, the operators must be sure that the ground at each front and rear lifting units 12 and 14 is substantially level. Moreover, they must check the minimal load-bearing capacity of the ground at each front and rear lifting units 12 and 14 to prevent any of these lifting units from sinking during the lifting operation of the mechanical shovel.

The second step consists of preparing the mechanical shovel. Having regard to the P&H 2300 XPA mechanical shovel, the revolving frame F' thereof must be turned at 180° with respect to the carbody C of the shovel to provide the space which is necessary to properly install the rear lifting beam 18 under the inclined portion at the rear of the revolving frame F' of the P&H 2300 XPA mechanical shovel. As to the P&H 2100, B-E 295BI and B-E295 BII, the revolving frames F and F", respectively, must be at 0° with respect to the carbody C of each of these shovels. The dipper handle, the boom and the bucket of the mechanical shovel are then removed. This provides the access required for the installation of the front lifting beam 12.

Once the lifting area and the mechanical shovel have been prepared, the rear lifting assembly, i.e. the rear lifting beam 18 and the associated rear lifting units 14, can be installed. Accordingly, when required, a pair of rear brackets corresponding to the model of mechanical shovel to lift are mounted to the connection plates 218 of the rear lifting beam 18 (i.e. the inclined brackets 236 for the P&H 2300 and the horizontal bracket 222 for the B-E 295II). Thereafter, the rear lifting beam 18 is put in place with respect to the revolving frame F, F', F" of the mechanical shovel and maintained in position by means of holders (not shown) which are temporarily installed at each end of the rear lifting beam 18. After having so position the rear lifting beam 18, the rear lifting units 14 are respectively disposed at opposite ends of the rear lifting beam 18 under the beam connection members 180 thereof. Each cylinder 22 of both rear lifting units 14 are then connected to the hydraulic control unit (not shown) and extended so as to align the bolting pattern of the mounting box 172 of each rear lifting unit 14 with the bolting pattern of the beam connection members 180 of the rear lifting beam 18. Therefore, each rear lifting unit 14 is secured to the rear lifting beam 18 and the holders are removed. Thereafter, an absolute lifting elevation detector assembly 250 and a stroke length detector assembly 258 are mounted to each rear lifting unit 14, whereby the rear reference lifting plane can be established as explained hereinbefore.

The fourth step consists of mounting the front lifting assembly, i.e. the front lifting beam 16 and the front lifting units 12. As for the rear lifting beam 18, the front lifting beam 16 is first properly positioned with respect to the mechanical shovel. More particularly, the P&H 2300 XPA mechanical shovel is secured to the front lifting beam 16 by means of the pair of moveable hook assemblies 128 which extends from the front side of the front lifting beam 16. The P&H 2100 BLE is secured to the front portion of the lifting arms 118 while the B-E 295BI and 295BII mechanical shovels are secured to the rear portion of the lifting arms 118 which extend from the rear side of the front lifting beam 16, as explained hereinbefore. Therefore, it is not always the same side of the front lifting beam 16 which faces the mechanical shovel to be lifted. It is noted that a further operation is required for the P&H 2100 BLE and 2300 XPA mechanical shovels. Indeed, for these models, a spacing block 68 must be mounted on each front lifting unit 12. As for the rear lifting beam 18, a pair of holders (not shown) are used to temporarily support the front lifting beam 16. After having so positioned the front lifting beam 16, the front lifting units 12 are respectively disposed at opposite ends of the front lifting beam 16 under the beam connection members 82. Each cylinder 20 of both front lifting units 12 are then connected to the hydraulic control unit (not shown) and extended to thus allow for the bolting of each beam connection member 82 of the front lifting beam 16 to its corresponding front lifting unit 12 so that the holders can then be removed. Accordingly, for the P&H mechanical shovels, the front lifting beam 16 is secured to the spacing block 68 which is mounted on the mounting box 50 of each front lifting unit 12 while for the B-E mechanical shovels the front lifting beam 16 is directly bolted to the mounting box 50 of each front lifting unit 12. Thereafter, as for the rear lifting assembly, an absolute lifting elevation detector assembly 250 and a stroke length detector assembly 258 are mounted to each front lifting unit 12, whereby the front reference lifting plane can be established, as explained hereinbefore.

After having calibrated and recorded the lifting plane, the mechanical shovel can be lifted by operation of the front and rear cylinders 20 and 22 of the front and rear lifting units 12 and 14. It is noted that the lifting operation can be automatically controlled by the automaton if desired.

It is further noted that, even though the preferred embodiment has been described with two rear lifting units 14 and two front lifting units 12, a single rear lifting unit 14 could have been used without departing from the scope of the present invention, although two front lifting units 12 would still be used to allow for the passage of the carbody C of the mechanical shovel therebetween once the revolving frame F thereof has been raised enough and that the shaft gudgeon of the carbody C is completely disengaged from the revolving frame F. The invert configuration, i.e. one front lifting unit 12 and two rear lifting units 14 could obviously also be realized.

Figure 15:
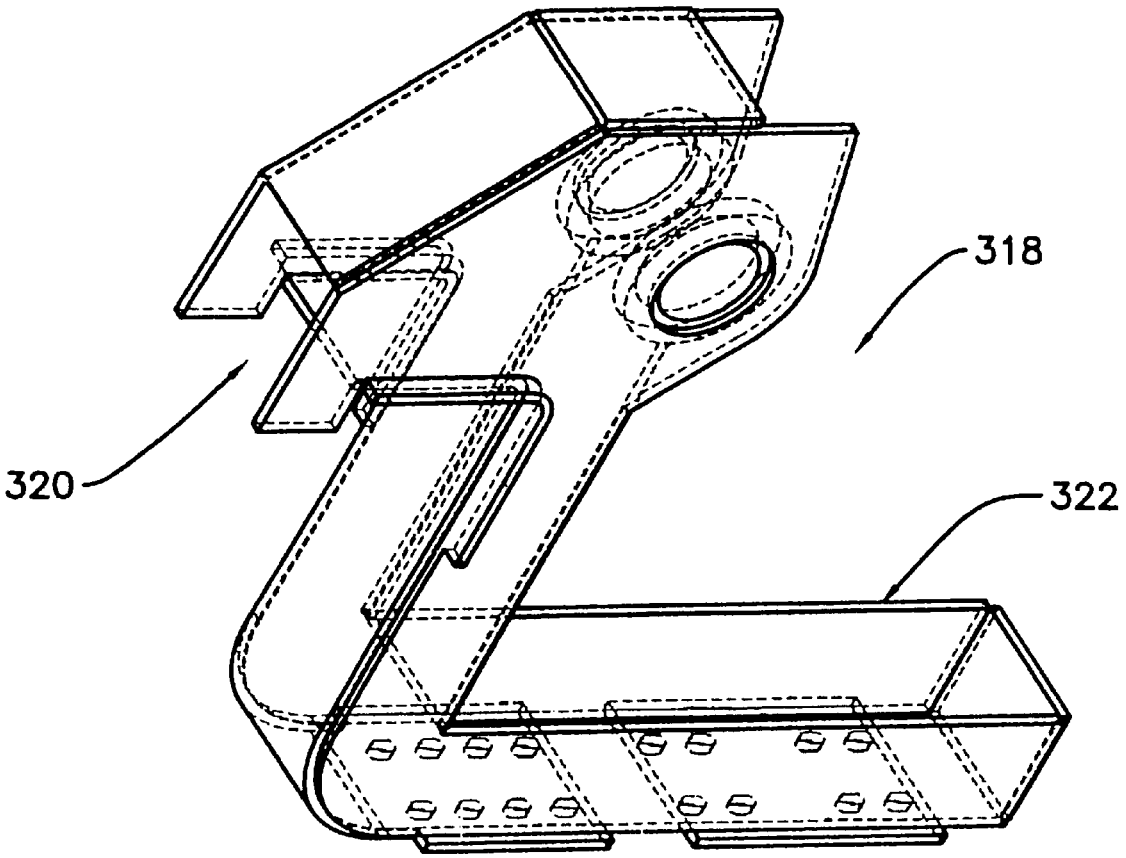
FIGS. 15 and 16 are perspective and elevational views of an alternate embodiment of the lifting arm.
Figure 16:
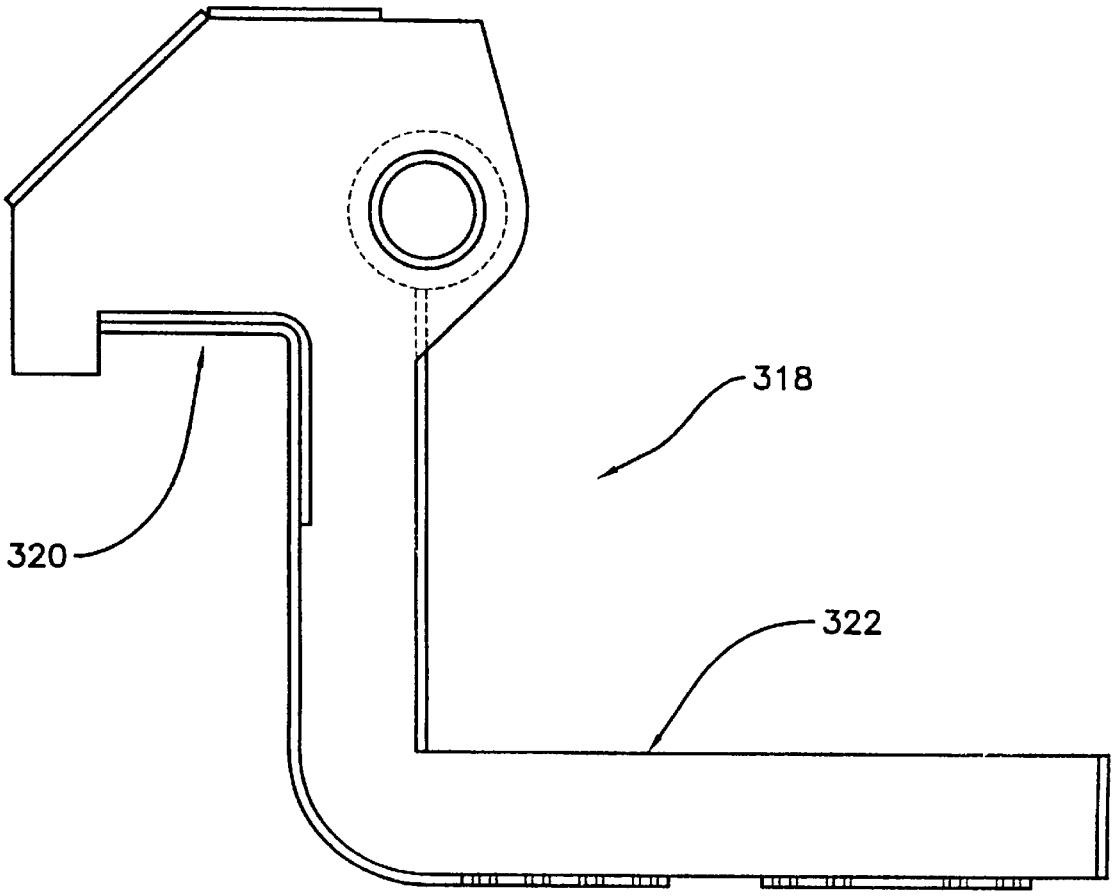

Also, it is readily understood that the lifting arms 118 can take on other configurations such as to allow the shovel lifting device 10 to lift the revolving frame of various mechanical shovels. For instance, FIGS. 15 and 16 illustrate a variant lifting arm 318 which is characterized by an upper hook 320 adapted to engage the top of the front lifting beam 16 and a lower support 322 adapted to support the revolving frame. The general configuration of the lifting arm 318 is well adapted for mechanical shovels such as the 2800XPB and the 2300XP (A+B) models. The lifting arm 318 replaces components 118, 120, 122, 124, 126, 132 and 140 of FIG. 4; components 120, 124, 126, 132, 136, 138, 140 and 142 of FIG. 9; and components 120, 124, 126, 128, 130, 132, 134, 136, 140, 146 and 148 of FIG. 10. The lifting arm or hook 318 replaces the lifting arm 118 of FIGS. 4, 9 and 10 which is welded to the front lifting beam 16.

What is claimed is:

1. A shovel lifting device comprising front and rear lifting beams which are adapted to support the revolving frame of a given mechanical shovel, front and rear lifting systems respectively adapted to control the vertical displacement of said front and rear lifting beams, said front and rear lifting systems comprising at least three lifting means, and connection means interconnecting said front and said rear lifting beams with said corresponding lifting means, whereby said revolving frame of said mechanical shovel can be lifted by operation of said lifting means of said shovel lifting device.

2. A shovel lifting device as defined in claim 1, wherein each said lifting means comprises a pair of cylinders mounted in parallel fashion, each cylinder of said pair being provided with an outer casing means which is slidably mounted on an inner casing means.

3. A shovel lifting device as defined in claim 2, wherein each said pair of cylinders is mounted at lower end thereof to a base structure.

4. A shovel lifting device as defined in claim 1, wherein said connection means comprises mounting boxes which are respectively mounted to each said lifting means and which include a head plate and a mounting plate extending from said head plate, said mounting plate being adapted to be mounted to said front or said rear lifting beam while said head plate is adapted to be mounted to said lifting means associated therewith.

5. A shovel lifting device as defined in claim 2, wherein said connection means of each said lifting means comprises a mounting box having a head plate and a mounting plate which extends from said head plate, the underside of said head plate being provided with two protuberances having respective coaxial recesses which are adapted to received the head of each said cylinder, said mounting plate being adapted to be mounted to said front or said rear lifting beam.

6. A shovel lifting device as defined in claim 1, wherein said connection means comprises spacing blocks, each said spacing block being mounted to said lifting means of said front lifting system so as to fill the difference in height that exists between the front and the rear of the underside of the revolving frame of said mechanical shovel.

7. A shovel lifting device as defined in claim 6, wherein said spacing block comprises a bottom plate, a top plate, two side walls extending between said bottom and top plates, a mounting plate disposed at the rear of said top and said bottom plate and a plurality of vertical and horizontal reinforcement plates extending from the inside of said spacing block said bottom plate being mounted to said lifting means of said front lifting system while said mounting plate of said spacing block being mounted to said front lifting beam, whereby said front lifting beam and said lifting means of said front lifting system thereof formed an integral assembly.

8. A shovel lifting device as defined in claim 5, wherein said connections means comprises spacing blocks, each said spacing block being mounted to said lifting means of said front lifting system so as to fill the difference in height that exists between the front and the rear of the underside of said revolving frame of said mechanical shovel, whereby the entire stroke of the cylinders of said lifting means of said font lifting system is available for the lifting operation.

9. A shovel lifting device as defined in claim 8, wherein said spacing block comprises a bottom plate, a top plate, two side walls extending between said bottom and top plates, a mounting plate disposed at the rear of said top and said bottom plate and a plurality of vertical and horizontal reinforcement plates extending from the inside of said spacing block, said bottom plate being mounted to said head plate of said mounting box while said mounting plate of said spacing block being mounted to said front lifting beam, whereby said front lifting beam and said lifting means of said front lifting system form an integral assembly.

10. A shovel lifting device as defined in claim 1, wherein said connection means comprises beam connection members mounted to said rear and said front lifting beams, said connection member being adapted to secure said front and said rear lifting beams to said lifting means associated therewith.

11. A shovel lifting device as defined in claim 10, wherein said front and said rear lifting beams are respectively provided at each end thereof with said beam connection member, said beam connection member including a mounting plate having rear and front surfaces, two side walls extending from said front surface and being adapted to received one of said lifting means, and a beam supporting structure extending from said rear surface of said mounting plate for securing said beam connection member to said rear or front lifting beam, whereby said front and rear lifting beams are connected to said lifting means associated therewith.

12. A shovel lifting device as defined in claim 9, wherein said connection means comprises beam connection members which are respectively mounted to each end of said rear and said front lifting beams, each said beam connection members being adapted to be mounted to said mounting plate of one of said mounting box or to said mounting plate of one of said spacing block in order to secure said front and rear lifting beams to said lifting means associated therewith.

13. A shovel lifting device as defined in claim 1, wherein said front and said rear lifting systems are each provided with two front lifting means and two rear lifting means.

14. A shovel lifting device as defined in claim 1, wherein said lifting means and said front and said rear lifting beams are provided with means for facilitating handling thereof.

15. A shovel lifting device as defined in claim 1, wherein said front lifting beam is provided with at least one bracket means which is adapted to cooperate with said mechanical shovel to ensure a proper positioning of said front and rear lifting beams with respect to said mechanical shovel.

16. A shovel lifting device as defined in claim 15, wherein said bracket means includes a pair of lifting arms secured to said front lifting beam and extending transversally therefrom, each said lifting arm comprising two spaced apart plates which are provided at each ends thereof with corresponding holes for receiving a coupling pin which is engaged with said revolving frame of said mechanical shovel, whereby said front lifting beam is fixed to said revolving frame of said mechanical shovel.

17. A shovel lifting device as defined in claim 15, wherein said bracket means includes a pair of movable hook members movably mounted in spaced relation on said front lifting beam, and means to displace said movable hook members transversally relative to said front lifting beams, said movable hook members being adapted to engage said revolving frame of said mechanical shovel, whereby said front lifting beam is fixed to said revolving frame of said mechanical shovel.

18. A shovel lifting device as defined in claim 17, wherein said movable hook members are respectively displaceable within a guide casing means by means of a screw bolt connected to each said movable hook member and extending through a screw hole defined in said guide casing means.

19. A shovel lifting beam as defined in claim 1, wherein said rear lifting beam is provided with at least one bracket means which is adapted to cooperate with said mechanical shovel to ensure a proper positioning of said front and rear lifting beams with respect to said mechanical shovel.

20. A shovel lifting device as defined in claim 19, wherein said mechanical shovel is the B-E 295 XPA model and wherein said bracket means comprises a pair of horizontal brackets removably mounted in space relation on said rear lifting beam, each said horizontal bracket having a top plate, a bottom plate adapted to be secured to said rear lifting beam, and spacing plates extending between said top and bottom plates, said top plate being adapted to support said revolving frame of said B-E 295 XPA mechanical shovel.

21. A shovel lifting device as defined in claim 19, wherein said mechanical shovel is the P&H 230 XPA model and wherein said bracket means comprises a pair of inclined brackets removably mounted in space relation on said rear lifting beam, each said inclined bracket having a base structure which is removably mounted on said rear lifting beam, a pair of spaced apart inclined support, a supporting plate mounted on each said spaced apart inclined support so as to form an inclined supporting plan which is similar to the underside of said revolving frame, and a protuberance extending from said supporting plate, said protuberance being adapted to engaged said revolving frame of said P&H 230 XPA mechanical shovel to ensure a proper positioning of said rear lifting beam relative to said revolving frame.

22. A shovel lifting device as defined in claim 3, wherein each said lifting means is provided with means to determine at least one of a length stroke of each said pair of cylinders and an absolute lifting elevation of the shovel at any time during the lifting operation, at least one of said length stroke and said absolute lifting elevation being transmitted to an automaton which is adapted to control the lifting operation of the shovel, whereby the initial lifting plan is maintained during all the lifting operation.

23. A shove lifting device as defined in claim 22, wherein each said lifting means is provided with an absolute lifting elevation detector comprising holder means extending substantially at right angles from said lifting means, a detector means mounted at the end of said holder means, said detector means being connected to a cable which is secured at an opposite end thereof to a plate, said plate being anchors in the soil, whereby the lifting elevation relative to the ground is computed at each said lifting means.

24. A shovel lifting device as defined in claim 22, wherein each said lifting means is provided with a stroke length detector comprising a detector means connected to said pair of cylinders, a cable mounted at one end thereof to said detector means and at opposite end thereof to said base structure of said pair of cylinders, whereby the stroke of said cylinders is computed at each said lifting means.

25. A shovel lifting device as defined in claim 24, wherein said cable is protected by a vertical guard.

26. A shovel lifting device comprising a front and a rear lifting beams, each of said front and said rear lifting beam being provided with at least one bracket means cooperating with a mechanical shovel having an upper part and a lower part to ensure a proper positioning of said front and said rear lifting beams with respect to said mechanical shovel, front and rear lifting Systems adapted to control the vertical displacement respectively of said front and rear lifting beans wherein said front and said rear lifting systems comprise at least three lifting means, whereby said upper part of the shovel can be lifted by operation of said lifting means of said shovel lifting device.

27. A shovel lifting device as defined in claim 15, wherein said bracket means includes a pair of lifting arm secured to said front lifting beam and extending transversally therefrom, each said lifting arm comprising an upper hook means and a lower support means adapted respectively to engage said front lifting beam and to support said revolving frame of said mechanical shovel, thereby allowing said front lifting beam to lift said revolving frame.

* * * * *